US005710961A

United States Patent [19]

Jeong

[11] Patent Number: 5,710,961

[45] Date of Patent: Jan. 20, 1998

[54] AGITATOR OF DEVELOPING DEVICE

[75] Inventor: Ki-Hyun Jeong, Songtan, Rep. of Korea

[73] Assignee: Samsung Electronics Co., Ltd., Kyungki-do, Rep. of Korea

[21] Appl. No.: 652,694

[22] Filed: May 30, 1996

[30] Foreign Application Priority Data

May 30, 1995 [KR] Rep. of Korea ..... 11910/1995

[51] Int. Cl.[6] ..... G03G 15/08

[52] U.S. Cl. ..... 399/256; 399/254; 366/325.93

[58] Field of Search ..... 399/256, 254, 399/119, 255; 222/DIG. 1; 366/279, 292, 297, 305, 306, 315–324, 325.92, 325.93

[56] References Cited

U.S. PATENT DOCUMENTS 3,999,514 12/1976 Abbott et al. .
4,449,810 5/1984 Ikesue et al. .
4,583,842 4/1986 Shimono et al. .
4,978,997 12/1990 Bell .
5,016,053 5/1991 Ibuchi et al. .
5,294,968 3/1994 Ueda et al. .
5,430,532 7/1995 Ueda et al. .
5,442,423 8/1995 Edmunds et al. .
5,506,665 4/1996 Ishida et al. .

*Primary Examiner*—R. L. Moses
*Attorney, Agent, or Firm*—Robert E. Bushnell, Esq.

[57] ABSTRACT

An improved agitator containing toner box for an electrophotographic device that is easier to manufacture and assemble than conventional agitator containing toner boxes. The first of two improvements is that one, instead of two apertures are formed in the toner box to accommodate the agitator shaft. The second improvement is that instead of using bushings inserted into an aperture to prevent toner leakage from the toner box, a cone-shaped seal is placed on the shaft of the agitator and over the aperture to prevent toner leakage through the aperture. These two improvements result in a much simpler and less expensive manufacturing and assembly process.

11 Claims, 3 Drawing Sheets

AGITATOR OF DEVELOPING DEVICE

CROSS-REFERENCE TO RELATED APPLICATIONS

This application makes reference to, incorporates the same herein, and claims all benefits accruing under 35 U.S.C. §119 arising from an application for Agitator of Developing Device earlier filed in the Korean Industrial Property Office on 30 May 1995 and there duly assigned Ser. No. 11910/1995.

FIELD OF THE INVENTION

The present invention relates to an electrophotographic processor such as a laser beam printer, a copying machine, or a facsimile system and, more particularly, to an agitator of a developing device that has a compact structure upon coupling the agitator to the developing device.

BACKGROUND OF THE INVENTION

Toner boxes with agitators are frequently found in electrophotographic processors. For example, U.S. Pat. No. 5,430,532 for a Developing Device with a Tilt Detecting Function Designed for a Trickle System to Ueda et al. discloses a toner box or developer vessel used in an electrophotographic machine. The agitator in Ueda '532 is inserted through only one side face of the developer vessel. More recently, U.S. Pat. No. 5,506,665 for a Developing Device Having Detachable Toner Box for Use in Image Recording Apparatus to Ishida et al. disclose an agitator containing toner box for an electrophotographic device. The agitator is inserted through only one aperture in the toner box, thus eliminating any need to form a second aperture in a toner box to accommodate a shaft of an agitator.

Although one-aperture toner boxes may already be available, I have found that such toner bores use a bushing to prevent toner from leaking out via the aperture, a feature that I have found to unnecessarily complicate the manufacturing and assembly process.

SUMMARY OF THE INVENTION

It is therefore an object of the present invention to provide a less expensive and simpler mechanism and process for coupling an agitator shaft to a toner box during assembly.

It is another object to improve the productivity in assembling agitator containing toner boxes by providing a more efficient design for a toner box.

It is yet another object to provide an agitator of a developing device for reducing the assembly process since an unnecessary aperture is not formed in the housing while providing a seal to prevent the leaking of toner from the toner box through the aperture by placing a seal over the aperture as opposed to inside the aperture.

These and other objects can be achieved according to the present invention with a developing device having a toner box that has only one aperture to accommodate the rotating shaft of a toner agitator. On a wall opposite the aperture containing wall of the toner box, a vertical slot is formed to guide the agitator shaft into the aperture during assembly. Before the agitator shaft is inserted into the toner box, a seal is fitted onto the shaft at a location so that when the agitator shaft is installed, the seal is positioned snugly up against the aperture containing wall so that the aperture is covered, preventing toner from leaking out of the toner box through the aperture during the operation of the electrophotographic device.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar elements components, wherein.

DETAILED DESCRIPTION OF THE INVENTION

Figure 1:
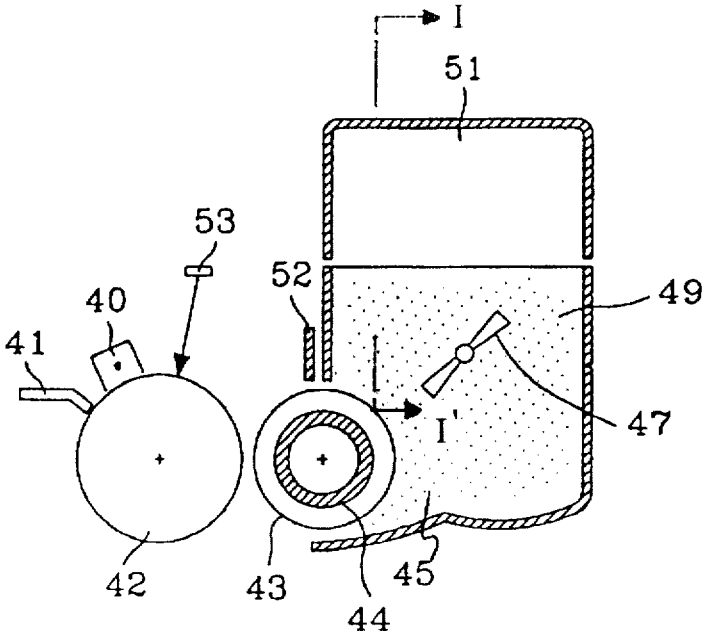
FIG. 1 is a schematic diagram illustrating the construction of an image forming apparatus of a general electrophotographic processor.

Turning now to the drawings, FIG. 1 is a schematic diagram illustrating the construction of an image forming apparatus of a general electrophotographic processor. An explanation on a general printing process of the image forming apparatus of the electrophotographic processor will now be given with reference to FIG. 1. When supplied to a toner storing unit 51, toner 49 and carrier 45 are agitated by agitator 47. This agitation generates static electricity by friction, thus creating a uniform charge on the particles. Toner 49 and carrier 45, charged as described above, is transferred onto the surface of sleeve 43 by the magnetic force of magnetic roller 44. At this time, doctor blade 52 causes toner 49 and carrier 45 (colloquially called "toner", hereinafter referred to as toner) to be formed on the surface of sleeve 43 at a uniform height.

Thus, when the surface of photosensitive drum 42 is electrically and uniformly charged by a corona discharge of charging unit 40, and a portion of rotating photosensitive drum 42 is exposed by exposing unit 53 after receiving an electric signal to form an image, resulting in an electrostatic latent image to be formed on the exposed portion. At this point, while passing a developing magnetic roller 44 and sleeve 43 situated adjacent to the surface of photosensitive drum 42, the electrostatic latent image is developed and then converted into a visible image so as to become a toner image. Next, after a recording sheet provided to a paper feeding cassette is fed by a feeding roller, the toner image of the surface of photosensitive drum 42 is transferred to the recording sheet by the high pressure of a transferring unit. While the recording sheet is passed between a heating roller and a pressure roller, the image is fixated at the surface of the recording sheet by heat and pressure and the recording sheet is transferred to a supporter. Meanwhile, the residual toner and the latent image at the surface of photosensitive drum 42 is removed by cleaning device 41, and the residual charge is removed by a charge removing lamp.

Figure 2:
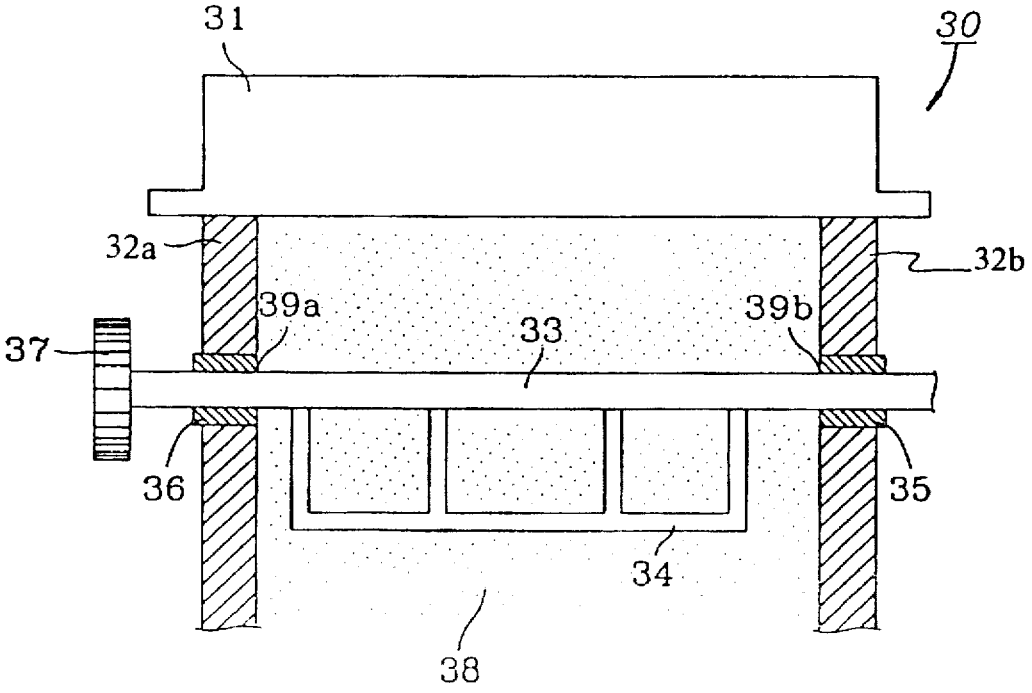
FIG. 2 is a sectional view of FIG. 1 taken along I I' with an agitator in a stationary position.

FIG. 2 is a sectional view illustrating the construction of an agitator of a simplified representation of a hypothetical conventional developing device 30, in which agitator 34 agitating and uniformly charging toner particles 38 is installed inside developing device 30, and hopper 31 is installed at an upper portion of developing device 30. Developing device 30 contains first sidewall 32*a* perforated by aperture 39*a* which, in turn contains bushing 36, and a second sidewall 32*b* opposite first sidewall 32*a*, perforated by second aperture 39*b* which, in turn contains bushing 35. After assembly, shaft 33 extends through both first aperture 39*a* in first sidewall 32*a* and second aperture 39*b* in second sidewall 32*b*. Bushings 35 and 36 prevent toner 38 from leaking from apertures 39*b* and 39*a* of sidewalls 32*b* and 32*a* respectively of developing device 30. Agitator gear 37, located at one end of shaft 33, is rotated by driving force of a drive gear (not shown).

The procedure for assembling conventional developing device 30 is as follows. After one end of shaft 33 is fitted into aperture 39*a* formed in first sidewall 32*a*, the other end of shaft 33 is fitted into second aperture 39*b* formed in sidewall 32*b* opposite first sidewall 32*a*. Then, agitator 34 is capable of being formed with the shaft 33, either unitedly or separately.

Thus, after bushings 35 and 36 for preventing the toner 38 from being leaked from developing device 30 is fitted at the both ends of shaft 33 of agitator 34, bushings 35 and 36 are fittingly coupled to second and first slots 39*b* and 39*a* respectively. See FIG. 2. Bushings 35 and 36 are generally made of an inflexible material. Hereafter, following the coupling of the agitator gear 37 to one end of shaft 33, hopper 31 is coupled to housing 32. As stated hereinbefore, agitator 34 agitates and charges toner particles 38 under the driving force of a driving gear (not shown).

The fact that shaft 33 of agitator 34 is coupled to first and second apertures 39*a* and 39*b* in sidewalls 32*a* and 32*b* respectively makes the manufacturing and assembly process of developing device 30 complicated. In addition, toner particles 38 have two apertures through which to leak from and there are two apertures through which the interior of developing device 30 can be contaminated by. Moreover, because each of bushings 35 and 36 is necessary for preventing toner particles 38 from leaking, the cost required for installing bushings 35 and 36 becomes high. As a result, there is a problem in that the productivity thereof can be reduced due to the difficult assembly process in fitting agitator 34 into developing device 30.

Figure 3:
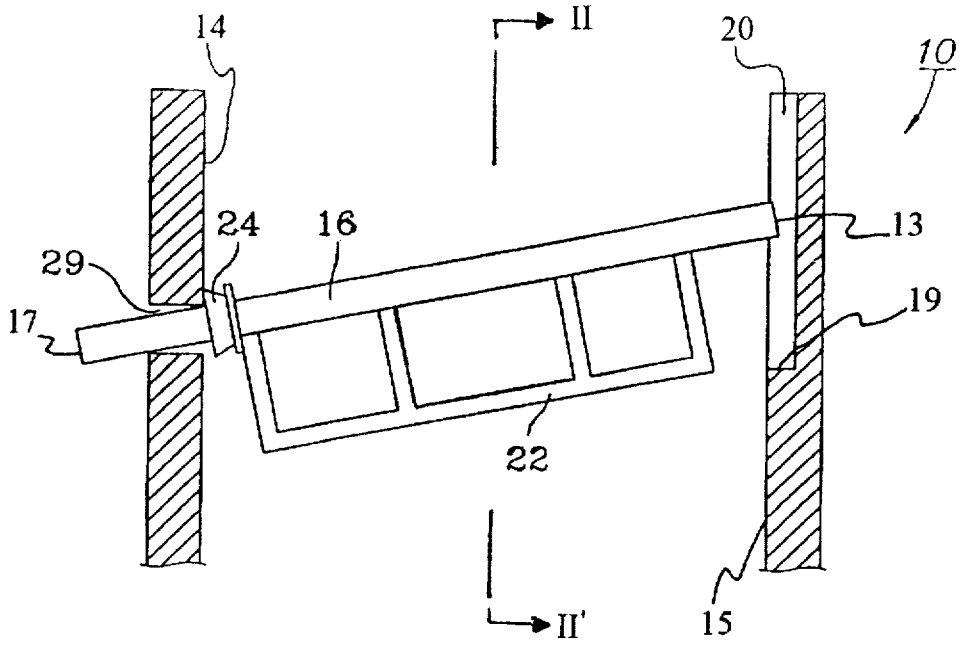
FIG. 3 is a schematic diagram illustrating a state where an agitator according to the present invention is being coupled to a developing device.
Figure 4:
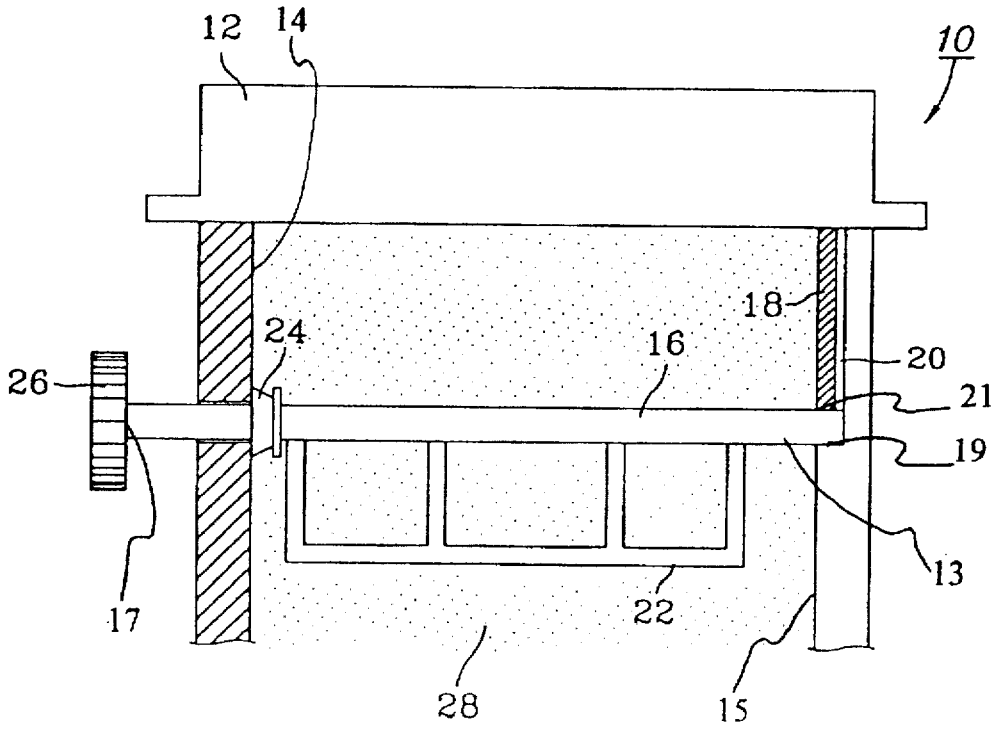
FIG. 4 is a sectional view illustrating the construction of an agitator of a developing device according to the present invention.
Figure 5:
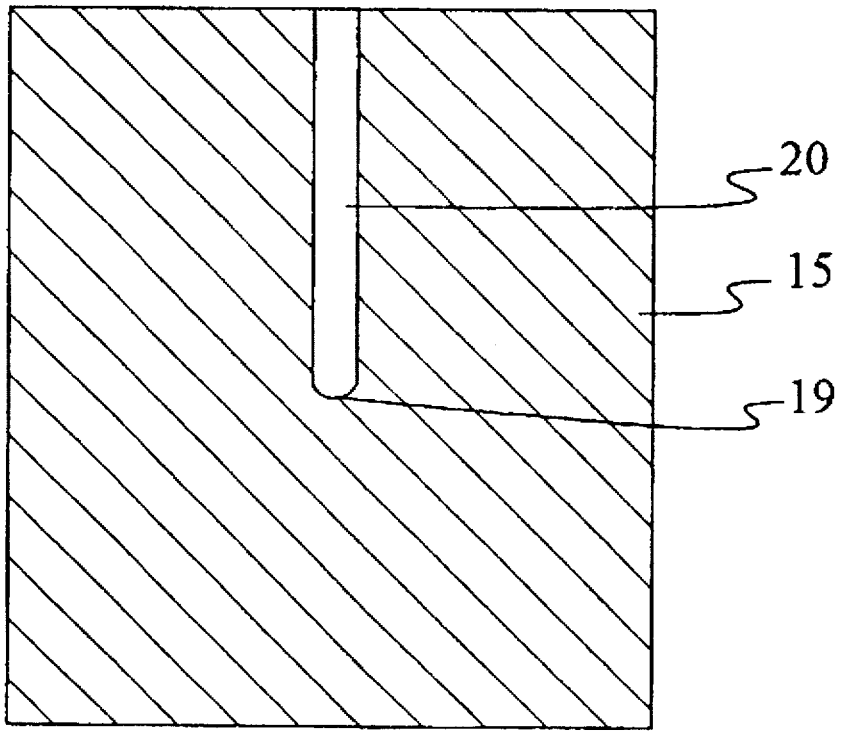
FIG. 5 is a sectional view of the developing device in FIG. 3 taken along II II' with the agitator and shaft omitted for clarity.

FIG. 3 illustrates an agitator being installed into developing device 10 constructed according to the principles of the present invention. FIG. 4 illustrates an agitator completely installed in developing device 10 according to the present invention. As shown in FIGS. 3 and 4, developing device 10 has hopper 12 on top a toner box having first and second interior sidewalls 14 and 15 respectively. Agitator shaft 16 is positioned in developing device 10. Agitator shaft 16 contains first end 17 and second end 13. Agitator shaft 16 is attached to agitator 22 which agitates and charges toner particles 28. First interior sidewall 14 is perforated by aperture 29 to accommodate first end 17 of agitator shaft 16, while second sidewall 15, opposite to first sidewall 14, contains no aperture. Instead, second sidewall 15 contains vertical slot 20 to guide second end 13 of agitator shaft 16 during installation. See FIGS. 3 & 5. Vertical slot 20 contains curved bottom 19 to match the cylindrically curved surface of agitator 16. Seal 24, fitted around agitator shaft 16, is positioned over aperture 29 of first interior sidewall 14 of the toner box and prevents toner particles 28 from escaping from the toner box through aperture 29. Unlike bushings 35 and 36, seal 24 is exterior to aperture 29, while bushings 35 and 36 lie inside the aperture. Also, unlike bushings 35 and 36 which are generally made of an inflexible material, seal 24 is often made of a flexible, elastic material, such as rubber. Seal 24 is conical in shape, with the large radius end up against first interior sidewall 14 when installed, and the tapered region of seal 24 on shaft 16 away from first interior sidewall 14. See FIG. 4. The assembled developing device 10 shown in FIG. 4 also contains rib 18 fixedly attached to hopper 12 and positioned in vertical slot 20. The bottom surface 21 of rib 18 is curved to match the cylindrically curved surface of shaft 16. Also, assembled developing device 10 contains agitator gear 26 attached to shaft 16 on the exterior of the toner box. Agitator gear 26 is driven by a driving gear (not shown).

The assembly procedure of developing device 10 according to the embodiment of the present invention will now be discussed. First, seal 24 is fitted onto shaft 16 at a location on shaft 16 towards first end 17 so that seal 24 will snugly fit up against first interior sidewall 14 and cover aperture 29 when shaft 16 is installed into developing device 10. Then, first end 17 of shaft 16 is placed into aperture 29 on the inside side of developing device 10. Meanwhile, second end 13 of shaft 16 is guided to the top of slot 20. First end 17 is slid into aperture 29 as second end 13 is guided down slot 20 of second interior sidewall 15. First end 17 of shaft 16 eventually emerges on the exterior side of the toner box, emerging from aperture 29 while second end 13 of shaft 16 eventually reaches and rests on bottom 19 of slot 20 of second interior sidewall 15. Seal 24 should now be snugly positioned up against first interior sidewall 14, covering aperture 29. Agitator gear 26 is installed on first end 17 of shaft 16. Lastly, hopper 12 is attached to the toner box. As this is done, rib 18, formed at the lower portion of hopper 12, is inserted into slot 20. Since bottom surface 21 of rib 18 is curved, it mates with the cylindrically curved surface of shaft 16. Hopper 12 is then ultrasonically welded to the toner box, causing bottom surface 21 of rib 18 to hold shaft 16 in place when shaft 16 is being rotated.

As apparent from the foregoing, the agitator of the developing device according to the present invention has many advantages as follows. That is, upon coupling the agitator to the developing device, the structure thereof can be compact, the working time thereof can be reduced, and the productivity thereof can be improved. In addition, now that no unnecessary aperture is formed at the housing upon fitting the shaft of the agitator into the aperture of the housing, the assembly process thereof can be reduced. As well, it has an effect on reducing the production cost without separately installing other units for preventing the toner from leaking.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment discloses as the best mode contemplated for carrying out the present invention, but that the present invention includes all embodiments falling within the scope of the appended claims.

What is claimed is:

1. A developing device, comprising:

a hopper;

a housing having a first interior sidewall and a second interior sidewall opposite to said first interior sidewall;

an agitator positioned to move toner within said hopper;

a shaft for driving said agitator, said shaft having a first end and a second end;

said first interior sidewall of said housing containing an aperture for accommodating said first end of said shaft;

a seal formed around said shaft of said agitator, said seal located adjacent to said first interior sidewall of said housing and covering said aperture, blocking passage of the toner from said housing via said aperture;

a slot formed on said second interior sidewall of said housing opposite to said first interior sidewall, accommodating radial movement of said second end of said shaft of said agitator into said housing of said developing device; and a rib obstructing movement of said second end of said shaft along said slot during rotation of said agitator.

2. The device of claim 1, comprising a lower portion of said rib being vertically rounded to match the shape of said shaft of said agitator for contact with said shaft of said agitator.

3. The device of claim 1 where said seal is comprised of:

a conical section adjacent to said first interior sidewall, said conical section containing a wide end and a narrow end, said wide end positioned adjacent to said first interior sidewall of said housing, the radius of said seal along said shaft decreases linearly with distance from said first interior sidewall;

a cylindrical section adjacent to said narrow end of said conical section, where the radius of said cylindrical section is equal to the radius of said conical section at said wide end.

4. The device of claim 3, where said seal is comprised of an elastic material.

5. The device of claim 4, where said elastic material is rubber.

6. The device of claim 1, where said rib is monolithically integrated to said hopper.

7. The device of claim 6 having said rib capable of being fit into said vertical slot of said second interior sidewall when said hopper and said housing are assembled together.

8. The device of claim 1 having said agitator and said shaft forming a single, integrated monolithic unit.

9. The device of claim 1 having said housing perforated by only one aperture to accommodate said shaft, said aperture located on said first interior sidewall of said housing.

10. A method for assembling a toner box for a developing device, comprising:

placing a seal around a shaft of a toner agitator with said seal being oriented towards a first end of said shaft of said toner agitator;

inserting said first end of said shaft of said toner agitator into an aperture formed in a first interior sidewall of said toner box;

placing said second end of said shaft of said toner agitator at an end of a slot formed in a second interior sidewall of said toner box opposite from said first interior sidewall;

guiding said second end of said shaft of said toner agitator down said slot while sliding said first end of said shaft of said toner agitator through said aperture in said first interior sidewall, until said second end of said shaft of said toner agitator rests on a bottom of said vertical slot in said second interior sidewall of said toner box and causing:

said first end of said shaft of said agitator to protrude from said aperture in said first interior sidewall of said toner box, and said seal, while placed around said shaft of said toner agitator, to be pressed against said first interior sidewall of said toner box covering said aperture in said first interior sidewall of said toner box; and covering said toner box with a hopper, causing a rib to be inserted down into said slot until said rib makes contact with said second end of said shaft, preventing said second end of said shaft of said toner agitator from moving up and down along said vertical slot when said shaft of said toner agitator is rotating.

11. The process of claim 10, comprised of said hopper being joined with said toner box via ultrasound welding.

* * * * *